US011939102B2

(12) United States Patent
Dillard et al.

(10) Patent No.: US 11,939,102 B2
(45) Date of Patent: Mar. 26, 2024

(54) FRONT FLAP LIFTING MECHANISM

(71) Applicant: ILLINOIS TOOL WORKS INC., Glenview, IL (US)

(72) Inventors: Robert Leslie Dillard, Easley, SC (US); Jon Paul Laskis, Simpsonville, SC (US); J. Mark Nunn, Simpsonville, SC (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 206 days.

(21) Appl. No.: 17/499,250

(22) Filed: Oct. 12, 2021

(65) Prior Publication Data

US 2022/0127027 A1 Apr. 28, 2022

Related U.S. Application Data

(60) Provisional application No. 63/105,560, filed on Oct. 26, 2020.

(51) Int. Cl.
*B65B 7/20* (2006.01)

(52) U.S. Cl.
CPC ..... *B65B 7/20* (2013.01)

(58) Field of Classification Search
CPC ..... B65B 43/39
USPC ..... 53/382.3, 377.2
See application file for complete search history.

(56) References Cited

U.S. PATENT DOCUMENTS 4,191,005 A * 3/1980 Vinoskey ..... B65B 43/39 53/382.3

FOREIGN PATENT DOCUMENTS

DE 2723044 A1 * 11/1978 ..... B66C 11/06
DE 10122969 A1 * 11/2002 ..... B27N 3/22

OTHER PUBLICATIONS

Wayne Automation Corporation, "WSTS Slitter Top Sealer," YouTube [Video], Jun. 9, 2017, Norristown, Pennsylvania, 0.28, https://www.youtube.com/watch?v=qXU_9X9Bcww (1 page).
Hamrick Manufacturing & Service, Inc., "Craft Brewery Packer/Sealer," YouTube [Video], Jun. 6, 2017, Kent, Ohio, 0.27, https://www.youtube.com/watch?v=CsA_2Zmbl2c (1 page).

* cited by examiner

*Primary Examiner* — Jacob A Smith
(74) *Attorney, Agent, or Firm* — Pauley Erickson & Swanson

(57) ABSTRACT

A lifting apparatus for a case on a conveyor system. A chain vertically hangs over a conveyor belt. A hook is positioned on an end of the chain. A piston retracts and releases the chain. The hook interacts with and moves front flaps on cases traveling on the conveyor system.

17 Claims, 6 Drawing Sheets

FRONT FLAP LIFTING MECHANISM

CROSS-REFERENCE TO RELATED APPLICATIONS

This application claims priority to U.S. Provisional Application, Ser. No. 63/105,560, filed 26 Oct. 2020. This U.S. Provisional Application is hereby incorporated by reference herein in its entirety and are made a part hereof, including but not limited to those portions which specifically appear hereinafter.

BACKGROUND OF THE INVENTION

Field of the Invention

This invention relates generally to conveying systems and, more particularly, to a lifting mechanism for raising a front flap on an object passing through a conveying system.

Description of Prior Art

In current conveyor systems, various objects, such as cases, pass through a conveying system for filling and closing the cases. In such systems, the case must be stopped or set at a specific pitch in a flight bar system so that a specific timing is achieved to lift a front flap of the case up to begin closing the case. This does not allow for cases to be intermittently placed on a continuous running conveyor. Other systems for lifting a forward-facing flap on a case include a ridged arm that may be changed out specific to each type of case passing through the conveyor. In either case, flaps are often not raised enough for closure of the case and therefore the flaps will not seal properly in current systems. This is especially true when a conveying system is utilizing re-used cases. Thus, a need exists for an improved lifting mechanism for conveyor systems without the additional interference of changing parts or stopping the system.

SUMMARY OF THE INVENTION

The invention generally relates to provide an improved mechanism to raise a forward-facing flap (e.g., front flap) on a case for closure while the case is passing through a conveyor system.

The general object of the invention can be attained, at least in part, through a lifting apparatus for a case on a conveyor system. The lifting apparatus includes a chain that can vertically hang over a conveyor belt, a hook positioned on an end of the chain, and a piston configured to retract and release the chain. The hook can interact with a front flap of an open case traveling on the conveyor belt. The hook can then engage the front flap of the case at a first position.

The piston is configured to at least partially retract the chain and then the hook can then engage the front flap at a second position. The case can continuously move on the conveyor belt while at the first position and the second position. The first position can occur when the case is open, and the second position can occur when the case is at least partially closed.

Additionally, the chain can include a plurality of links. The plurality of links may be aligned parallel to the conveyor system in that the links swing in a a direction parallel to the direction the conveyor belt is traveling. Each link of the plurality of links can pivot relative to each adjacent link about an axis perpendicular to the conveying direction. The hook includes a center of gravity in line with the chain. The hook also includes a polygonal hook bend, a hook throat and a hook saddle. The hook throat can engage the front flap of the case in the first position and the hook saddle can engage the front flap of the case in the second position.

The invention also includes method of lifting a portion of an object on a conveyor system. The method includes moving a plurality of objects on a conveyor belt. An object of the plurality of objects is in an open position having at least one flap. The method includes lowering a chain from a piston vertically hanging over the conveyor belt, hooking a hook onto an edge of the at least one flap and pulling the edge of the at least one flap with the hook by retracting at least a portion of the chain with the piston. The at least one flap includes a first position where the flap is vertically below a horizontal plane of the object and a second position where the flap is vertically above the horizontal plane of the object.

The method may further include retracting the chain with the piston and moving the at least one flap from the first position to the second position. The hook can release the at least one flap while continuously moving the object on the conveyor belt. The hook releases the chain to contact a flap in the first position of another object of the plurality of objects. The chain can be repeatedly retracted and released within the piston to continuously contact flaps of the plurality of objects moving through the conveyor system.

The invention further includes a lifting apparatus for use with a conveyor system including a flexible chain with a plurality of links. The flexible chain can vertically hang over a conveyor belt. The lifting apparatus also includes a hook on an end link of the chain where a weighted center of the hook is equal to a weighted center of the chain. A piston controls a vertical length of the chain and a chain guide track houses at least a portion of the vertical length of the chain.

The hook can engage a front flap of a case on the conveyor system when the case passes a sensor on the conveyor system and where the case is in an open position and the chain is at a first length. The piston is configured to at least partially retract the chain to a second length when the case engages the sensor and wherein the hook is adapted to move the front flap in a vertical direction from the open position to a closed position. A difference between the open position and the closed position of the front flap is at least 90 degrees.

BRIEF DESCRIPTION OF THE DRAWINGS

The above-mentioned and other objects and advantages will be apparent to those skilled in the art from the following detailed description taken in conjunction with the drawings wherein.

DETAILED DESCRIPTION OF THE INVENTION

The present invention provides a lifting apparatus that can be used with a conveyor system. The lifting apparatus includes a flexible member such as a chain suspended over a conveyor belt as a part of the conveyor system. A hook or other catch is positioned on an end of the flexible member while a piston and a chain guide track control a position of the chain that is suspended over the conveyor belt.

Figure 1:
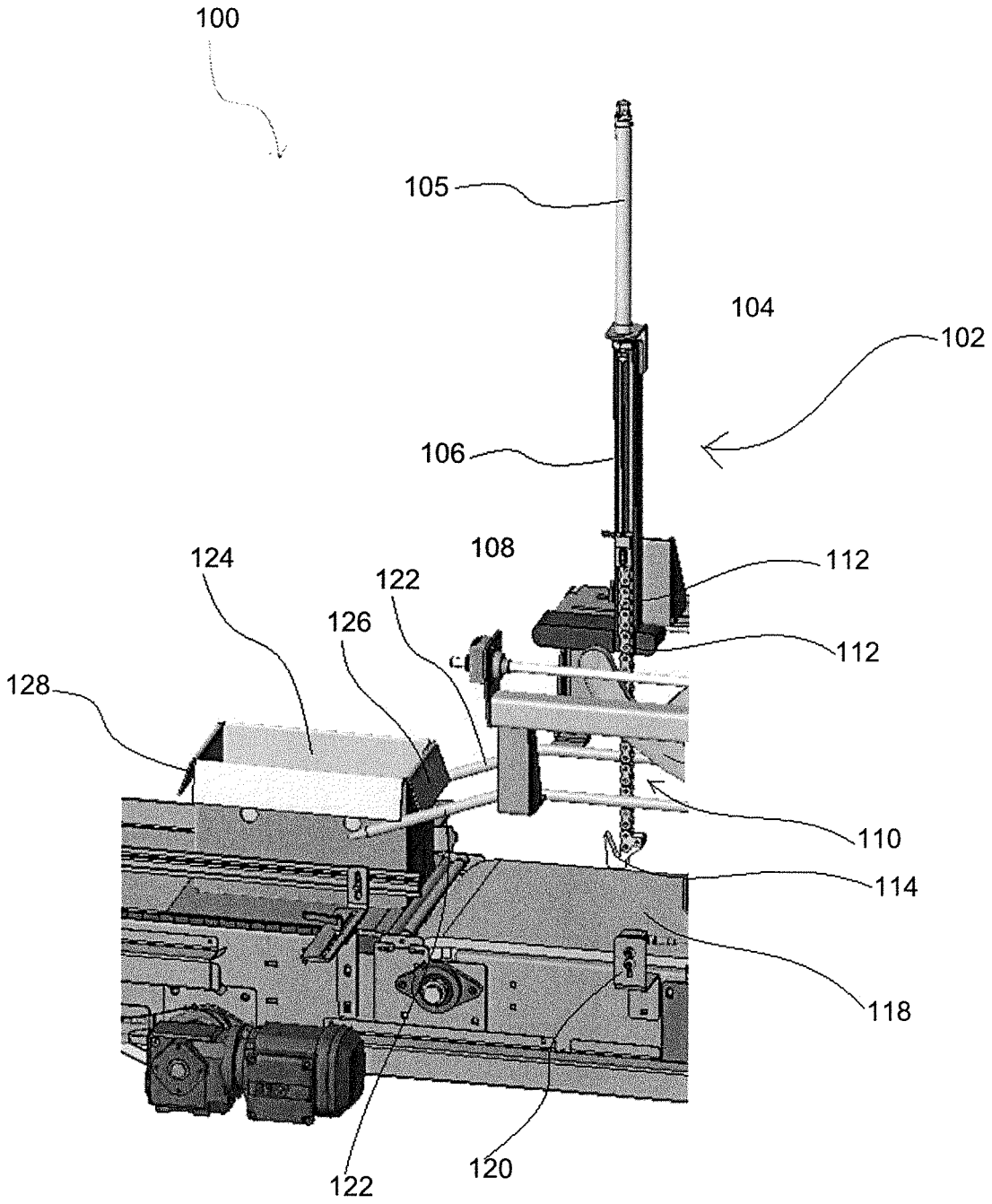
FIG. 1 is a perspective view of a lifting apparatus on a conveyor system according to one preferred embodiment of this invention.

FIG. 1 shows a conveyor system 100 according to one embodiment of the invention. As an example, the conveyor system 100 may be, or includes, a case sealer, although other systems may be used as well. The conveyor system 100 includes a conveyor belt 118. The conveyor belt 118 moves various products through the conveyor system 100. For example, the conveyor belt 118 may move a plurality of cases 124. As shown in FIG. 1, the case 124 is a cardboard box to house various items for transport and/or sale. In some examples, the cases may be pre-used recycled cases or slit tab locked cases. It is to be understood that the cases according to the invention may be of a variety of different types including various sizes, shapes, configurations, materials, and for housing various items. The case 124 as shown in the embodiment of FIG. 1 has an open top surrounded by four flaps that are used to close the open top of the case. A front flap 126 is oriented first in the conveying direction down the conveyor belt 118 before contacting a lifting apparatus 102.

Figure 2:
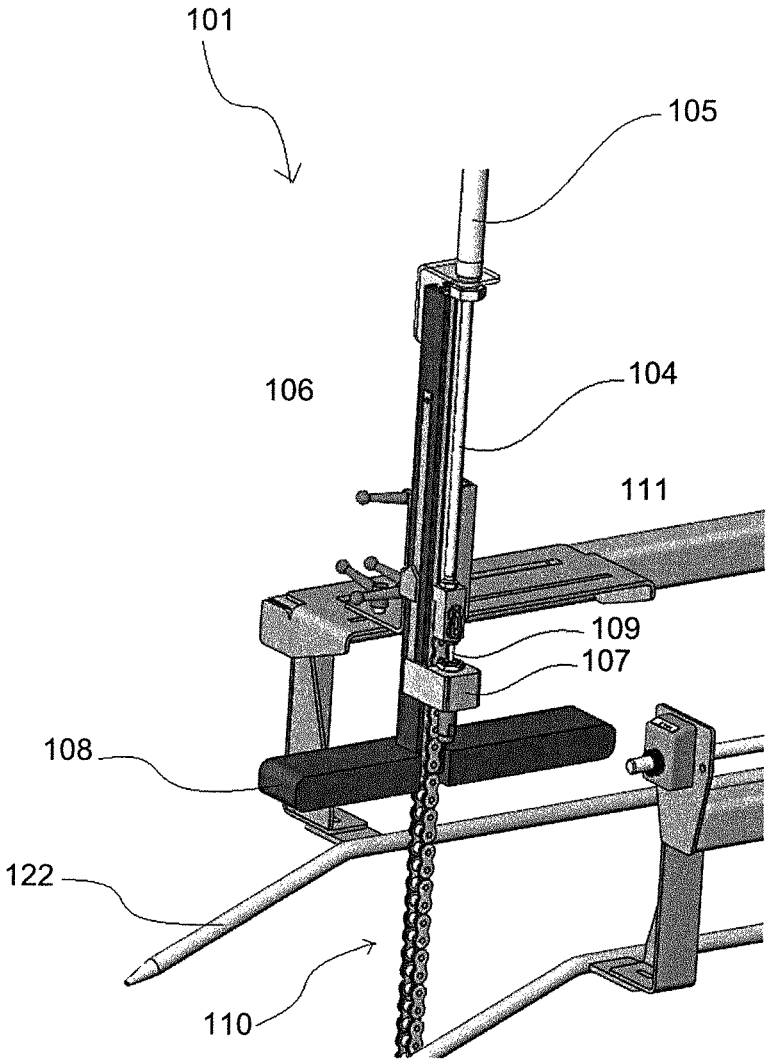
FIG. 2 shows a partial perspective view of the lifting apparatus on a conveyor system in a down position according to the embodiment of FIG. 1.

The lifting apparatus 102 as shown in FIG. 1 includes a piston 104 positioned above the conveyor belt 118. As shown, a chain guide track 106 is positioned adjacent to the piston 104. The chain guide track 106 houses a chain 110. One end of the chain 110 attaches to a piston end 111 as shown in FIG. 2. The chain 110 may be made up of a plurality of links 112. The plurality of links 112 run parallel to the conveyor belt 118. While the chain 110 as a whole is perpendicular to the conveyor belt 118, each individual link of the plurality of links 112 aligns on top of one another parallel with the direction of the conveyor belt 118. That is, the chain 110 swings with a conveying direction of the belt 118. The chain 110 hangs, desirably vertically, over a portion of the conveyor belt 118 awaiting the case 124. A position of the chain 110 may be controlled by a combined effort of the piston 104 and the chain guide track 106. The lifting apparatus 102 additionally includes a hook 114 situated at an end of the chain 110 for engaging the front flap.

In the illustrated embodiment, while the case 124 moves down the conveyor belt 118, it is contacted by a pair of opposing of guide rails 122. The guide rails 122 may position the case 124 while the case 124 is traveling down the conveyor belt 118. The guide rails 122 may also be angled to lift and aid in closing slide flaps of the case 124 by hugging one or more side perimeters of the case 124 to cause any present side flaps of the case to move vertically upward toward a closed position.

Next, the case 124 passes a sensor 120. The sensor 120 detects an edge of the front flap 126 of the case 124 from a fixed position relative to the lifting apparatus 102 to indicate when the hook shall be raised. The front flap 126 of the case 124 will then reach the hook 114 on the chain 110. The hook 114 is adapted to a specific length so that the hook 114 will "hook" onto the edge of the front flap 126 of the case 124. The piston 104 retracts the chain 110 which in turn causes the hook 114 to move vertically upward. When the hook 114 moves upward, the hook engages an edge of the front flap 126. As the case 124 moves forward, the hook 114 engages the edge, raising the front flap 126 of the case 124. After a predetermined distance relative to the sensor 120 is achieved, the chain 110 can be retracted inside the chain guide track 106 while the hook 114 continues to engage the front flap 126 until the front flap 126 is pulled completely vertical (at least 90 degrees upwards), or past vertical, over the case 124. Retracting the hook 114 also reduces or eliminates the hook 114 from dragging through the center of the case 124 potentially hooking on, or otherwise damaging or disturbing, contents inside the case 124. As the chain 110 is retracted, the chain guide track 106 stabilizes and calms the chain 110 to take turbulence out of the movement from the piston 104 retracting the chain upwards. After the cases passes, the hook 114 is extended back down into position ready for the next case 124. The efficiency of the conveyor system 100 allows less space needed between subsequent cases, allowing more cases to pass through the system in less time. The chain 110 allows enough flexibility for the front flap 126 to be at varying angles with respect to a side of the case 124 and still cause the hook 114 to engage with the edge of the front flap 126. The upward motion from the piston 104 causes the front flap 126 to also move vertically upward to pull the front flap 126 in a closed position.

Figure 3:
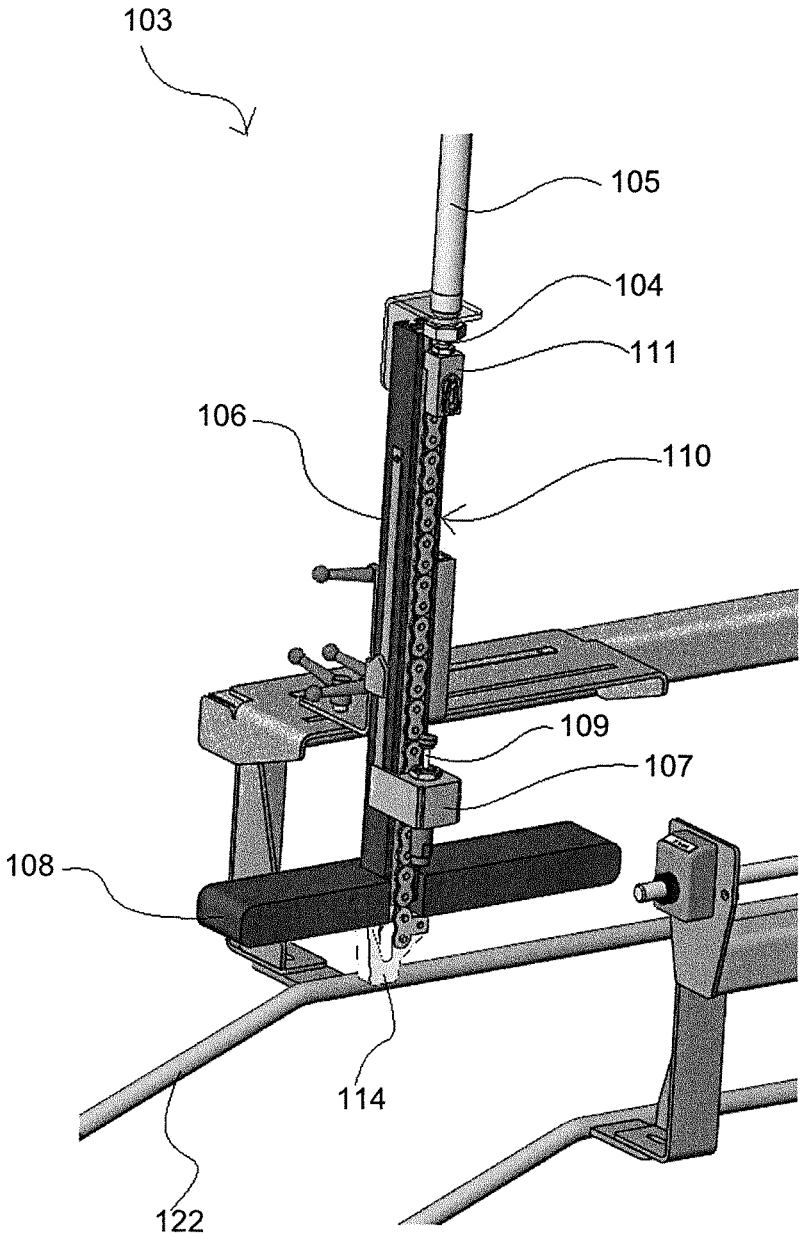
FIG. 3 shows a partial perspective view of the lifting apparatus on a conveyor system in an up position according to the embodiment of FIG. 1.

FIG. 2 shows the chain in a down position 101. The chain 110 has a length that is equal to a length of the chain guide track 106. While the length of the chain 110 remains the same, the piston 104 works in conjunction with an air cylinder 105 to move the chain 110 up and down through the chain guide track 106. The chain guide track 106 aids to stabilize the chain 110 when the chain 110 is lifted and lowered to various positions. In the down position 101 the piston 104 extends out of the air cylinder 105 so that the chain 110 is extended down closer to the conveyor belt 118. As seen in FIG. 3, the hook 114 and chain 110 are drawn upwards into the chain guide track 106 in the up position 103. When completely in the up position 103, the entire length of the chain 110 is contained in the chain guide track 106. Additionally, the end 111 of the piston 104 is adjacent to an end of the air cylinder 105 when the piston 104 is fully retracted inside the air cylinder 105 in the up position. The air cylinder 105 can be a piece of tubing to house the piston 104. While the piston and air cylinder are used as shown, it is to be understood that in other embodiments various other elements may be used to reciprocate the chain up and down.

In other embodiments of the invention, a damper 107, such as a piston with a spring, may also be placed between the piston 104 and the chain guide track 106 to additionally control deceleration of the chain as the chain is moved down the chain guide track, therefore further lessening any sort of whip effect or back and forth movement of the chain. The down position 101 uses the damper 107 positioned at a point along the chain guide track 106. The damper 107 can assist the piston 104 as the chain 110 moves to the down position. The damper 107 further includes a damper piston 109. The damper piston 109 makes contact with the piston end 111 when the chain 110 reaches the down position 101. The damper piston 109 aids to slow deceleration of the chain 110 to allow the chain 110 to come to a smooth stop when alternating positions, such as from the up position 103 to the down position 101 as shown in FIG. 3.

Figure 4:
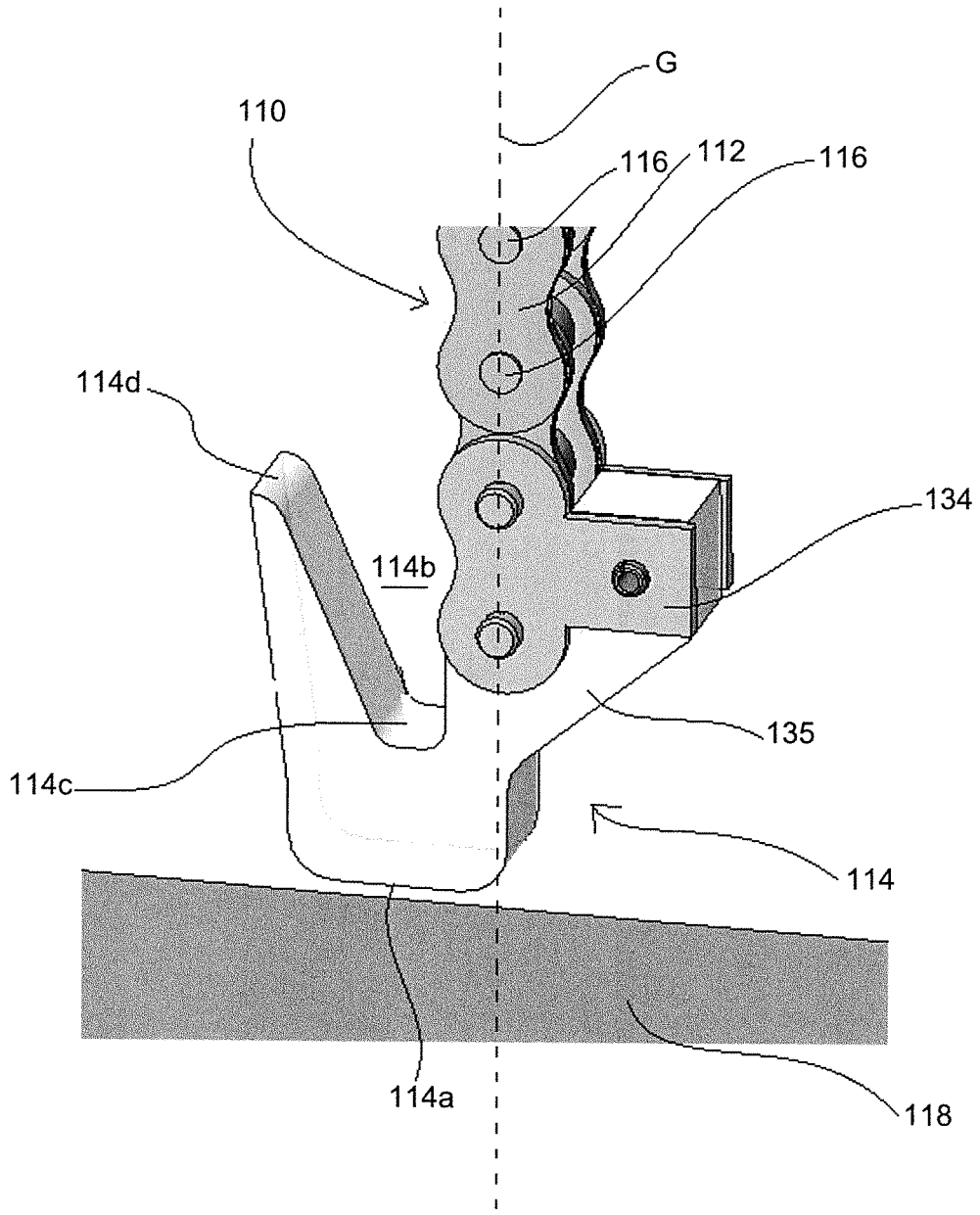
FIG. 4 is a perspective view of a hook portion of the lifting apparatus in the down position on a conveyor system according to the embodiment shown in FIG. 1.

FIG. 4 shows the hook 114 for engaging the front flap 126 of a case 124 in the down position. The hook 114 includes a hook bend 114*a*. The hook bend 114*a* may be polygonal in shape to aid in a desired distribution of weight within the hook. However, it is to be understood that the hook bend 114*a* may be of other relevant shapes and sizes such as round, or with squared corners. Also shown in FIG. 4, the hook 114 includes a hook throat opening 114*b* for receiving the front flap 126 after an edge of the front flap 126 makes initial contact with a hook point 114*d*. The hook point 114*d* is preferably tapered in nature, however, the hook point 114*d* may be tapered at varying angles such as an angle less than 90 degrees. As the piston 104 retracts a portion of the chain 110, the hook throat 114*b* guides the edge of the front flap 126 to a hook saddle 114*c*. As the hook 114 pivots about the links 112 of the chain 110, the front flap 126 can be thrust back onto the case 124 (to a closed positioned) from the hook saddle 114*c*.

An end 134 of the chain 110 attaches to the hook 114. The end 134 may be a link 112 of the plurality of links, or any other suitable attachment means to join the hook 114 and the chain 110. Each link 112 in the chain 110 may also include an axis 116 from which to rotate about. The links 112 may include multiple axes 116 in other additional embodiments. The axes 116 allow the links 112 to collectively pivot relative to each other (about the axes) when the hook 114 engages the front flap 126 of a case 124. The pivoting flexibility in each link 112 allows the chain 110 to conform to the position of the front flap 126 as the case 124 travels forward on the conveyor belt 118. The pivoting flexibility of each link 112 also allows the hook 114 to always remain in close proximity to the front of a case 124 passing through the conveyor system 100 with little to no lateral displacement of the chain 110. The chain guide track 106 aids to keep the chain 110 straight when the chain 110 is retracted and released at varying positions by the piston 104. The length of the chain 110 stays the same while its position (and therefore the position of the hook 114) is adjusted up or down depending on case size.

Additionally, the links 112 of the chain 110 and the hook 114 are synchronized with a specific geometry and weight so that the hook 114 and the chain 110 collectively share a center of gravity (G). The hook 114 on the end 134, has geometry designed in such a way that the center of gravity (G) is in line with the chain 110. As shown in FIG. 4, the hook 114 also includes a balance section 135. The end 134 has an offset section as shown that connects with the balance section 135. The hook bend 114*a* has a weight that coincides with weight of the balance section 135 and the end 134 to maintain the center of gravity (G). This prevents the hook 114 from aggressively swinging before engaging the front flaps 126 of cases 124. The hook 114 reduces or eliminates any swinging or bouncing once the chain 110 is fully extended down, while waiting for the next case 124. Stabilization of any swing action of the hook 114 allows cases 124 to be closer together when traveling on the conveyor belt 118 which increases the overall efficiency of the system 100. The piston 104 can repeatedly retract and release portions of the chain 110 to continuously contact flaps of objects moving through the conveyor system 100.

Figure 5:
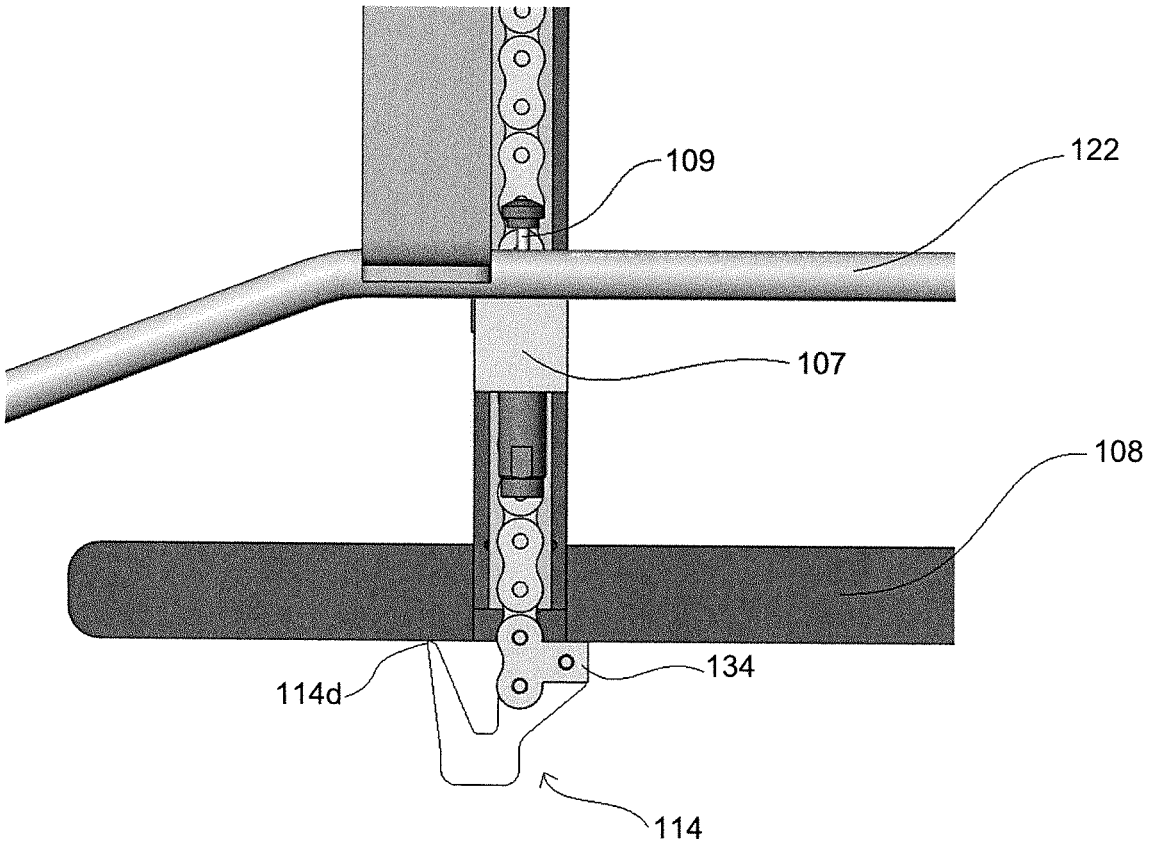
FIG. 5 is a side view of the hook portion of the lifting apparatus in the up position on the conveyor system according to the embodiment shown in FIG. 1.

When the hook 114 is in the up position, as shown in FIG. 5, the hook 114 contacts a stop 108 at an end of the chain guide track 106. Precisely, the end 134 of the chain and the hook point 114*d* are aligned at a same elevation. This allows the hook point 114*d* and the end 134 to simultaneously contact the stop 108 when the system reaches the up position 103 where the entire length of the chain 110 is retracted in the chain guide track 106.

Figure 6A:
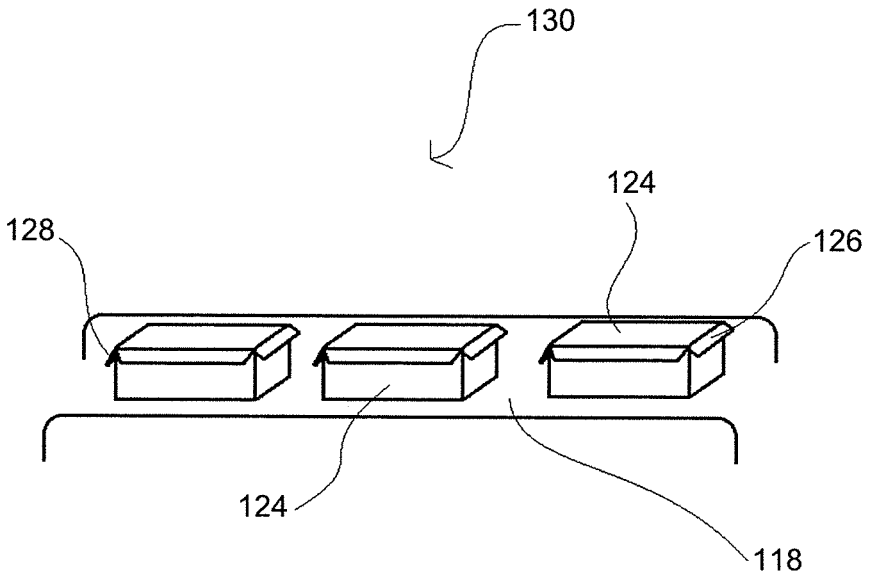
FIG. 6A is a perspective view of a plurality of cases on the conveyor system according to the embodiment shown in FIG. 1.

FIG. 6A shows an embodiment of the invention where a plurality of cases 124 are in an open or first position 130. This open or first position 130 shows cases 124 where all flaps (namely front 126 and rear 128) are open. In this position 130, the flaps are vertically below a horizontal plane of the case 124. The open position 130 occurs to any and all objects traveling through the conveyor system 100 prior to reaching the lifting apparatus 102.

Figure 6B:
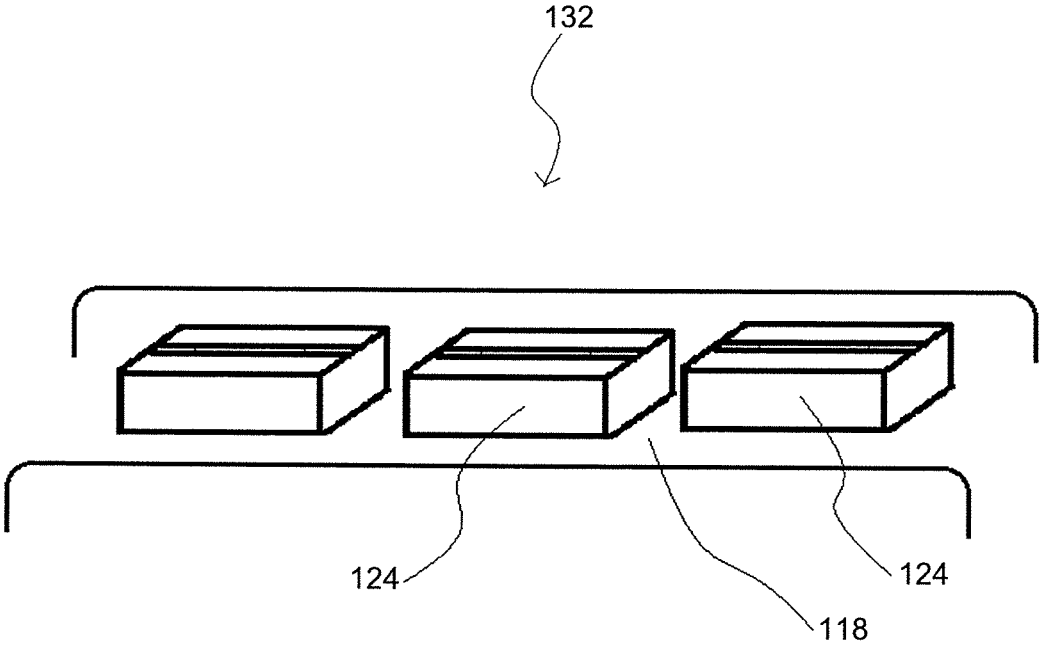
FIG. 6B is a perspective view of a plurality of cases on the conveyor system according to the embodiment shown in FIG. 1.

FIG. 6B shows an embodiment of the invention where a plurality of cases 124 are in a closed or second position 132. This closed or second position 132 shows cases 124 where all flaps are closed. The closed position 132 occurs to any and all objects traveling through the conveyor system 100 after passing through the lifting apparatus 102. In comparison to the first position 130, in the second position 132 the flaps that have been modified by the conveyor system and/or lifting apparatus are now vertically above (or at least even with) the horizontal plane of the object or case 124 traveling through the system. In other embodiments of the invention the lifting apparatus may only partially close objects traveling through the conveyor system.

In some embodiments, the invention additionally includes an arm as a part of the conveyor system. The arm can work with a lifter to engage a rear flap of a case. Various configurations of the arm or similar feature will be understood by those with ordinary skill in the art. It is also to be understood that the combination of the lifting apparatus, guide rails and arm may be modified and utilized to close packages or cases of other varying configurations. The combined efforts result in cases with front and rear flaps being completely folded down so that the cases can then successfully enter a case top sealer downstream from the conveyor system. Here, adhesive can be applied to the flaps before a top of the case is sealed and completely folded down. The cases and/or objects are able to continuously move down the conveyor belt while passing through any and all parts of the lifting apparatus and conveyor system.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A lifting apparatus for a case on a conveyor system, the lifting apparatus comprising:

a chain adapted to vertically hang over a conveyor belt;

a hook positioned on an end of the chain, wherein the hook is adapted to engage a front flap of an open case on the conveyor belt at a first position;

a piston configured to retract and extend the chain; and a chain guide track wherein the piston is configured to at least partially retract the chain into the chain guide track at a second position while the hook is engaged with the front flap and wherein the case is adapted to continuously move on the conveyor belt while at the first position and the second position.

2. The lifting apparatus according to claim 1 wherein the piston is configured to completely retract the chain into the chain guide track until the hook reaches a stop.

3. The lifting apparatus according to claim 1 wherein the case comprises the first position when the case is open.

4. The lifting apparatus according to claim 3 wherein the case comprises the second position when the case is at least partially closed.

5. The lifting apparatus according to claim 1 wherein the piston further comprises a piston end wherein the piston end contacts a damper when the piston extends the chain.

6. The lifting apparatus according to claim 1 wherein the chain further comprises a plurality of links wherein the plurality of links are aligned parallel to a conveying direction of the conveyor belt of the conveyor system.

7. The lifting apparatus according to claim 6 wherein each link of the plurality of links is adapted to pivot relative to an adjacent link about an axis wherein the axis is perpendicular to the conveying direction of the conveyor belt.

8. The lifting apparatus according to claim 1 wherein the hook includes a center of gravity in line with a center of gravity of the chain.

9. The lifting apparatus according to claim 1 wherein the hook further comprises a polygonal hook bend, a hook throat and a hook saddle.

10. The lifting apparatus according to claim 9 wherein the hook throat and a hook point are adapted to engage the front flap of the case in the first position.

11. The lifting apparatus according to claim 10 wherein the hook saddle is adapted to engage the front flap of the case in the second position.

12. A method of lifting a portion of an object on a conveyor system with the lifting apparatus of claim 1, the method comprising:

moving a plurality of objects on the conveyor belt wherein an object of the plurality of objects is in an open position having at least one flap;

releasing the chain from the chain guide track with the piston wherein the chain is vertically hanging over the conveyor belt;

hooking the hook onto an edge of the at least one flap wherein the hook is operatively attached to an end of the chain; and pulling the edge of the at least one flap with the hook by retracting at least a portion of the chain with the piston.

13. The method of claim 12 wherein the at least one flap comprises the first position wherein the flap is vertically below a horizontal plane of the object.

14. The method of claim 13 wherein the at least one flap further comprises the second position wherein the flap is vertically above the horizontal plane of the object.

15. The method of claim 14 further comprising retracting the chain with the piston until the hook contacts a stop and moving the at least one flap from the first position to the second position.

16. The method of claim 15 further comprising the hook releasing the at least one flap and the conveyer belt continuously moving the object on the conveyor belt and wherein the hook releases the chain until a piston end contacts a damper to contact a flap in the first position of another object of the plurality of objects.

17. The method of claim 16 further comprising repeatedly retracting and releasing the chain with the piston to continuously contact flaps of the plurality of objects moving through the conveyor system.

* * * * *